US007188588B2

(12) United States Patent
Hewkin

(10) Patent No.: US 7,188,588 B2
(45) Date of Patent: Mar. 13, 2007

(54) COOLING SYSTEM AND COOLANT RESERVOIR FOR A COOLING SYSTEM

(75) Inventor: David Hewkin, Battle Creek, MI (US)

(73) Assignee: Mann & Hummel GmbH, Ludwigsburg (DE)

( * ) Notice: Subject to any disclaimer, the term of this patent is extended or adjusted under 35 U.S.C. 154(b) by 0 days.

(21) Appl. No.: 11/272,768

(22) Filed: Nov. 15, 2005

(65) Prior Publication Data

US 2006/0118067 A1 Jun. 8, 2006

Related U.S. Application Data

(60) Provisional application No. 60/627,282, filed on Nov. 15, 2004.

(51) Int. Cl.
*F01P 9/00* (2006.01)
*F01P 3/22* (2006.01)

(52) U.S. Cl. ..... 123/41.54; 165/104.32

(58) Field of Classification Search ..... 123/41.54; 165/104.32
See application file for complete search history.

(56) References Cited

U.S. PATENT DOCUMENTS 5,353,751 A * 10/1994 Evans ..... 123/41.54
6,056,139 A * 5/2000 Gericke ..... 220/203.06

* cited by examiner

*Primary Examiner*—Noah P. Kamen
(74) *Attorney, Agent, or Firm*—Crowell & Moring LLP

(57) ABSTRACT

A cooling system for an engine includes a radiator and a reservoir. The reservoir includes upper and lower chambers and a conduit providing fluid communication between the upper and lower chambers. The upper chamber is usually in fluid communication with the radiator and the lower chamber has an opening that can open to the atmosphere, wherein the lower chamber is positioned below the upper chamber. The conduit having first and second openings, wherein the first and second openings are positioned respectively in the upper and lower chambers.

16 Claims, 2 Drawing Sheets

COOLING SYSTEM AND COOLANT RESERVOIR FOR A COOLING SYSTEM

This application claims the benefit of provisional Application No. 60/627,282, filed Nov. 15, 2004.

FIELD OF THE INVENTION

The present invention is directed to a cooling system, such as the cooling system of an internal combustion engine, and to a coolant reservoir for a cooling system.

BACKGROUND OF THE INVENTION

In a typical cooling system, such as the cooling system of an internal combustion engine, a coolant reservoir is used to receive coolant overflow from the radiator of the cooling system when the coolant in the radiator expands under high temperature, and to supply coolant to the radiator when the coolant in the radiator contracts when coolant temperature is reduced.

A coolant reservoir typically includes two volumes. The first volume is the coolant volume, which is the volume occupied by the coolant contained in the reservoir. The second volume is the air expansion volume, which is the volume not occupied by the coolant and filled with air. In a conventional coolant reservoir, the air expansion volume is above the coolant volume because air is lighter than coolant. When the coolant reservoir receives coolant from the radiator, the coolant volume in the coolant reservoir increases, and the air expansion volume decreases. The reverse takes place, when the coolant in the radiator contracts and the coolant in the coolant reservoir is supplied to the radiator.

Several criteria are considered in the design and installation of a coolant reservoir. One of the criteria is that the coolant reservoir should be positioned sufficiently high relative to the radiator so that the coolant level in the reservoir is higher than the radiator coolant level. This ensures that the coolant in the coolant reservoir tends to flow into the radiator under gravity to ensure that the radiator is sufficiently filled with coolant. Another criterion is that the air expansion volume of a reservoir should be sufficiently large so that it can accommodate the amount of coolant flowing into the reservoir from the radiator.

Under certain circumstances, it is impossible for a conventional coolant reservoir to satisfy both of the above criteria. For example, when the radiator is positioned close to the roof (or cover) of the engine compartment, there may not be much space between the radiator coolant level and the roof. As a result, it is impossible to satisfy both of the above criteria, i.e., to ensure that the coolant level in the reservoir is higher than the radiator coolant level and to provide the coolant reservoir with a sufficiently large air expansion volume.

SUMMARY OF THE INVENTION

In accordance with one aspect of the invention, a cooling system for an engine includes a radiator and a coolant reservoir. The coolant reservoir includes an upper chamber in fluid communication with the radiator, a lower chamber positioned below the upper chamber, and a conduit providing fluid communication between the upper and lower chambers. The upper chamber of the reservoir may be used to accommodate the coolant volume, while the lower chamber may be used to accommodate the air expansion volume. Since the air expansion volume is positioned below the coolant volume, the coolant level in the reservoir (i.e., the elevation of the coolant volume) is no longer limited by the air expansion volume. As a result, even when the radiator is positioned close to the roof (or cover) of the engine compartment, it is possible to place the coolant reservoir sufficiently high relative to the radiator and to provide the coolant reservoir with a sufficiently large air expansion volume.

The conduit of the coolant reservoir has first and second openings, which may be positioned respectively in the upper and lower chambers. Preferably, the first opening of the conduit is positioned near the top of the upper chamber, and the second opening of the conduit is positioned near the bottom of the lower chamber. Further, the conduit may be contained within the upper and lower chambers.

The lower chamber has an opening, preferably near the top of the lower chamber, which opens to the atmosphere. A valve assembly may be provided at this opening. The valve assembly opens when the pressure inside the lower chamber is above a given value or when there is a vacuum inside the lower chamber.

In accordance with another aspect of the invention, a method of operating the engine cooling system includes some of the following steps. First, the upper chamber of the coolant reservoir is used to receive excess coolant from the radiator when the coolant in the radiator expands and to supply coolant to the radiator when the coolant in the radiator contracts. Second, the coolant may flow from the upper chamber to the lower chamber of the coolant reservoir through the conduit of the reservoir if the coolant level in the upper chamber is pushed above the first opening of the conduit as coolant flows into the upper chamber from the radiator. Third, coolant may flow from the lower chamber back to the upper chamber through the conduit if coolant is supplied from the upper chamber to the radiator when the coolant in the radiator contracts. Additionally, a pressure relief valve may be opened to allow air in the lower chamber to be released into the atmosphere through the opening of the lower chamber if the pressure in the lower chamber is above a given value. Furthermore, a one-way valve may be opened to supply air from the atmosphere to the lower chamber through the opening of the lower chamber if a vacuum is created in the lower chamber.

Other objects, advantages and novel features of the present invention will become apparent from the following detailed description of the invention when considered in conjunction with the accompanying drawings.

DETAILED DESCRIPTION OF PREFERRED EMBODIMENTS

Figure 1:
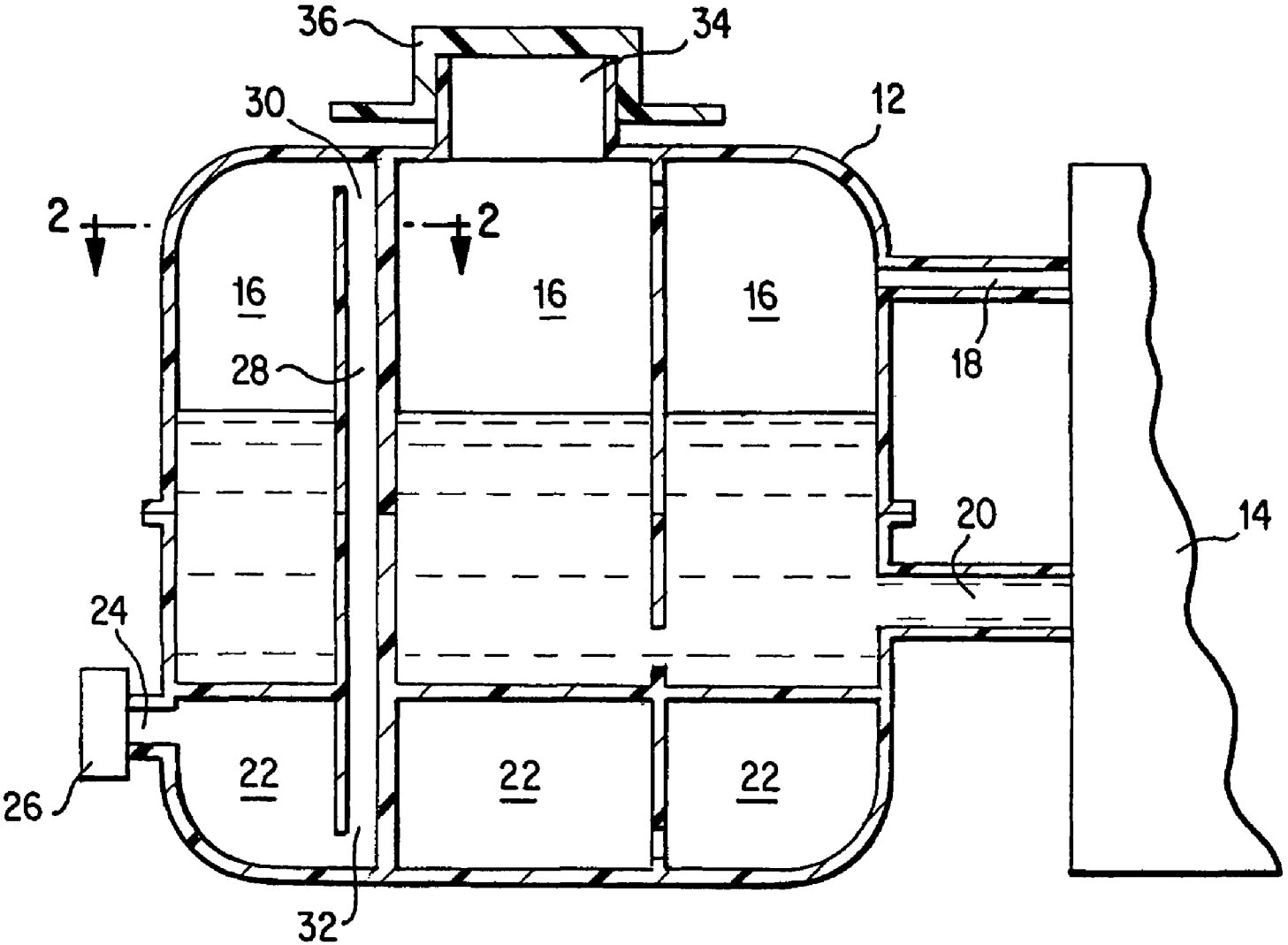
FIG. 1 is an elevation cross-section view schematically showing the coolant reservoir and radiator of a preferred cooling system of the present invention.

FIG. 1 schematically illustrates a preferred cooling system 10 of the present invention, which has a coolant reservoir 12 and a radiator 14.

Figure 2:
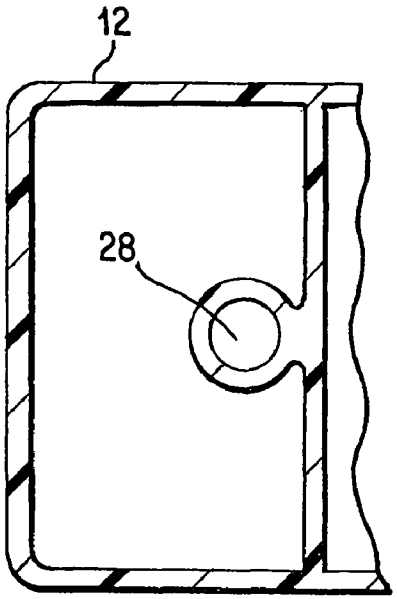
FIG. 2 is a partial top cross-section view of the coolant reservoir of FIG. 1.

The coolant reservoir 12 shown FIG. 1 has an upper chamber 16 that is in fluid communication with the radiator 14 via an inlet 18 and an outlet 20. The inlet 18 is used for coolant flow from the radiator 14 to the upper chamber 16, and the outlet 20 is used for coolant flow from the upper chamber 16 to the radiator 14. The coolant reservoir 12 also includes a lower chamber 22, positioned below the upper chamber 16, which has an opening 24 that opens to the atmosphere. A valve assembly 26 (schematically shown in FIGS. 1 and 3) may be provided at the opening 24. The coolant reservoir 12 further includes a conduit 28 between the upper and lower chambers 16, 22, as shown in FIGS. 1 and 2. The conduit 28 allows coolant flow between the upper and lower chambers 16, 22.

The conduit 28 has first and second openings 30, 32, which may be positioned respectively in the upper and lower chambers 16, 22. The vertical positions of the conduit's first and second openings 30, 32 can be important. Under certain conditions, the vertical position of the conduit's first opening 30 determines the coolant level in the reservoir's upper chamber 16, which in turn determines the coolant level in the radiator 14. Therefore, in order to keep the coolant level in the radiator 14 as high as possible, the conduit's first opening 30 should be kept as high as possible, preferably near the top of the upper chamber 16. In addition, the useful space of the lower chamber 22 (i.e., how much of the lower chamber 22 can be used to accommodate coolant overflow from the upper chamber 16) is determined by the vertical position of the conduit's second opening 32, because the coolant below the conduit's second opening 32 cannot be conveyed to the upper chamber 16 by the conduit 28. Therefore, the second opening 32 of the conduit 28 should be positioned near the bottom of the lower chamber 22. Further, the conduit 28 preferably is formed as an integral or unitary part of the upper and lower chambers 16, 22, as opposed to a detachable tube. And an integrated conduit 28 can not be accidentally detached. Preferably, the chambers 16, 22 and conduit 28 are formed together by molding.

Furthermore, how much coolant the reservoir's lower chamber 22 can accommodate, thus the size of the reservoir's air expansion volume, is determined, under certain circumstances, by the vertical position of the lower chamber's opening 24. The higher the position of the opening 24, the larger the size of the reservoir's air expansion volume. Therefore, it is preferable that the opening 24 be placed near the top of the lower chamber 22.

The coolant reservoir 12 shown in FIG. 1 is pressurized, although, in general, a coolant reservoir of the present invention can be pressurized or can operate under atmosphere pressure. In the pressurized coolant reservoir 12 shown in FIG. 1, the valve assembly 26 includes a pressure relief valve (not specifically shown) to set the reservoir pressure at a given value. The pressure relief valve opens to relieve the reservoir pressure when the reservoir pressure is above the given value. The valve assembly 26 may also include a one-way valve (not specifically shown) that opens to allow air into the lower chamber 22 when there is a vacuum inside the lower chamber 22.

Figure 3:
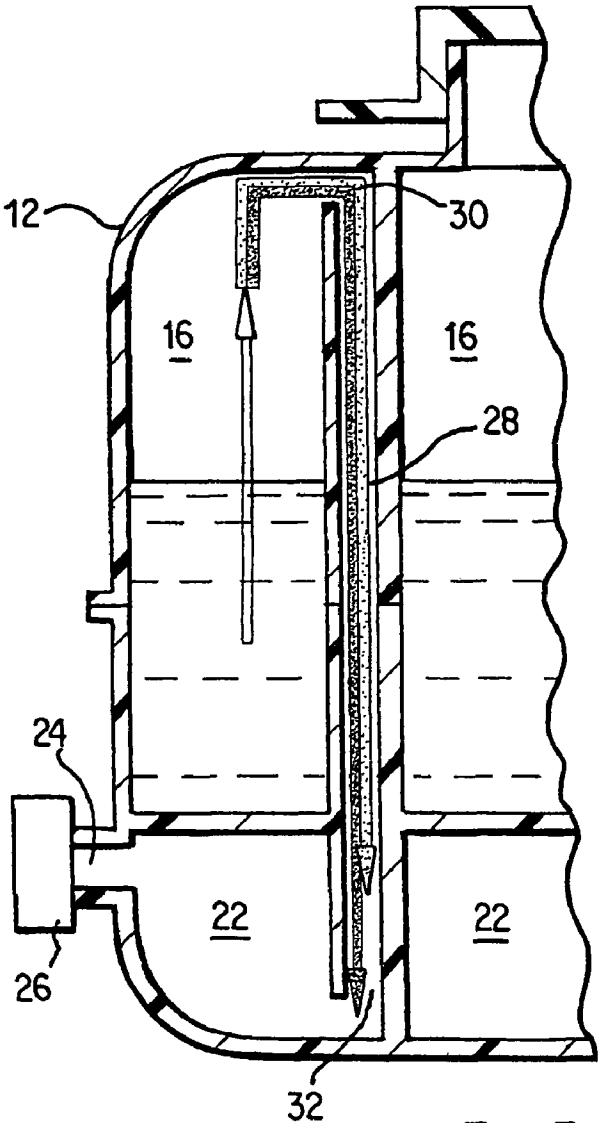
FIG. 3 is a partial elevation cross-section view of the coolant reservoir of FIG. 1 that illustrates the operation of the coolant reservoir.

It should be noted that FIGS. 1–3 are merely a schematic drawing. As a result, certain minor features of the coolant reservoir 12 are not shown. For example, although the reservoir shown in FIG. 1 is made from molded top and bottom halves that are welded together, it is preferable to make the reservoir from more than two parts to simply the molds for molding the parts.

The coolant reservoir 12 may include also another opening 34 and a cap 36 that can sealingly close the opening 34. The opening 34 can be used to add coolant to the cooling system 10. In the embodiment shown in FIG. 1, the opening 34 is placed on the upper chamber 16 of the coolant reservoir 12.

The operation of the coolant reservoir 12 is illustrated in FIG. 3. In operation, the upper chamber 16 is used to receive excess coolant from the radiator 14 when the coolant in the radiator 14 expands, and to supply coolant to the radiator 14 when the coolant in the radiator 14 contracts. If the coolant level in the upper chamber 16 rises as coolant flows into the upper chamber from the radiator 14, the coolant level may be pushed above the first opening 30 of the conduit 28 and may begin to flow into the lower chamber 22 through the conduit 28. If the pressure in the lower chamber 22 increases above a given value, the pressure relief valve will open to relieve the pressure. If the coolant is supplied from the upper chamber 16 to the radiator 14 when the coolant in the radiator 14 contracts, the coolant in the lower chamber 22 is pushed back into the upper chamber 16 through the conduit 28. If a vacuum is created in the lower chamber 22, the one-way valve opens to supply air to the lower chamber 22 through the lower chamber's opening 24.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. A cooling system for an engine, comprising:
a radiator; and
a reservoir including
an upper chamber in fluid communication with the radiator,
a lower chamber having an opening that opens to the atmosphere, wherein the lower chamber is positioned below the upper chamber, and
a conduit having first and second openings, wherein the first and second openings are positioned respectively in the upper and lower chambers so that the conduit provides fluid communication between the upper and lower chambers.

2. The cooling system of claim 1, wherein the first opening of the conduit is positioned near the top of the upper chamber, and wherein the second opening of the conduit is positioned near the bottom of the lower chamber.

3. The cooling system of claim 1, wherein the conduit is placed inside the upper and lower chambers.

4. The cooling system of claim 1, wherein the reservoir includes a valve assembly at the opening of the lower chamber, wherein the valve assembly opens when the pressure inside the lower chamber is above a given value or when there is a vacuum inside the lower chamber.

5. The cooling system of claim 4, wherein the opening of the lower chamber is placed near the top of the lower chamber.

6. The cooling system of claim 1, wherein the opening of the lower chamber is placed near the top of the lower chamber.

7. A coolant reservoir for an engine cooling system having a radiator, comprising:
an upper chamber in fluid communication with the radiator,
a lower chamber having an opening that opens to the atmosphere, wherein the lower chamber is positioned below the upper chamber, and a conduit having first and second openings, wherein the first and second openings are positioned respectively in the upper and lower chambers so that the conduit provides fluid communication between the first and second openings.

8. The coolant reservoir of claim 7, wherein the first opening of the conduit is positioned near the top of the upper chamber, and wherein the second opening of the conduit is positioned near the bottom of the lower chamber.

9. The coolant reservoir of claim 7, wherein the conduit is placed inside the upper and lower chambers.

10. The coolant reservoir of claim 7, wherein the reservoir includes a valve assembly at the opening of the lower chamber, wherein the valve assembly opens when the pressure inside the lower chamber is above a given value or when there is a vacuum inside the lower chamber.

11. The coolant reservoir of claim 10, wherein the opening of the lower chamber is placed near the top of the lower chamber.

12. The coolant reservoir of claim 7, wherein the opening of the lower chamber is placed near the top of the lower chamber.

13. A method of operating an engine cooling system including a radiator and a reservoir, wherein the reservoir includes an upper chamber in fluid communication with the radiator, a lower chamber positioned below the upper chamber and having an opening that opens to the atmosphere, and a conduit having first and second openings, wherein the first and second openings are positioned respectively in the upper and lower chambers so that the conduit provides fluid communication between the upper and lower chambers, the method comprising the steps of:

using the upper chamber to receive excess coolant from the radiator when the coolant in the radiator expands and to supply coolant to the radiator when the coolant in the radiator contracts;

coolant flowing from the upper chamber to the lower chamber through the conduit if coolant level in the upper chamber is pushed above the first opening of the conduit as coolant flows into the upper chamber from the radiator; and coolant flowing from the lower chamber back to the upper chamber through the conduit if coolant is supplied from the upper chamber to the radiator when the coolant in the radiator contracts.

14. The method of claim 13, further comprising the step of opening a pressure relief valve to allow air in the lower chamber to be released into the atmosphere through the opening of the lower chamber if the pressure in the lower chamber is above a given value.

15. The method of claim 14, further comprising the step of opening a one-way valve to supply air from the atmosphere to the lower chamber through the opening of the lower chamber if a vacuum is created in the lower chamber.

16. The method of claim 13, further comprising the step of opening a one-way valve to supply air from the atmosphere to the lower chamber through the opening of the lower chamber if a vacuum is created in the lower chamber.

* * * * *